US005083700A

United States Patent [19]

Mello et al.

[11] Patent Number: 5,083,700

[45] Date of Patent: Jan. 28, 1992

[54] TRIANGULAR CROSS-SECTION PACKAGE

[75] Inventors: Frank C. Mello; Jan Gullett, both of Zeeland, Mich.

[73] Assignee: Bil Mar Foods, Inc., Zeeland, Mich.

[21] Appl. No.: 538,755

[22] Filed: Jun. 15, 1990

[51] Int. Cl.[5] ..... B65D 25/54; B65D 30/28

[52] U.S. Cl. ..... 229/115; 206/806; 229/162; 383/120

[58] Field of Search ..... 206/45.31, 806; 229/106, 108, 108.1, 115, 117.01, 162; 383/84, 85, 88, 89, 120

[56] References Cited

U.S. PATENT DOCUMENTS

| | | | |
|---|---|---|---|
| 1,759,613 | 5/1930 | Greene | 229/108 |
| 2,177,972 | 10/1939 | Altheimer | 383/120 |
| 2,831,624 | 4/1958 | Lever | 383/120 |
| 3,144,931 | 8/1964 | Long | 383/120 |
| 3,166,235 | 1/1965 | Schroeder | 229/106 |
| 3,308,996 | 3/1967 | Beck | 206/621 |
| 3,312,337 | 4/1967 | Martin | 383/89 |
| 3,690,523 | 9/1972 | Link | 206/806 |
| 4,243,171 | 1/1981 | Prin | 229/117.01 |
| 4,402,452 | 9/1983 | Kupersmit | 229/117.01 |
| 4,638,912 | 1/1987 | Graf | 383/89 |

FOREIGN PATENT DOCUMENTS

| | | | |
|---|---|---|---|
| 0333759 | 12/1958 | Switzerland | 229/108 |
| 0504311 | 4/1939 | United Kingdom | 383/84 |
| 1085610 | 10/1967 | United Kingdom | 229/115 |

*Primary Examiner*—Jimmy G. Foster

*Attorney, Agent, or Firm*—Allegretti & Witcoff, Ltd.

[57] ABSTRACT

The improved display package of the present invention has a substantially triangular shape in longitudinal cross-section. The package is formed from substantially rectangular front and matching back panels. A pair of side panels are attached to the front and back panels. Each of the side panels is also rectangular in shape in the unfolded state, but includes an inwardly disposed triangular subpanel when folded along triangular-shaped fold lines.

24 Claims, 2 Drawing Sheets

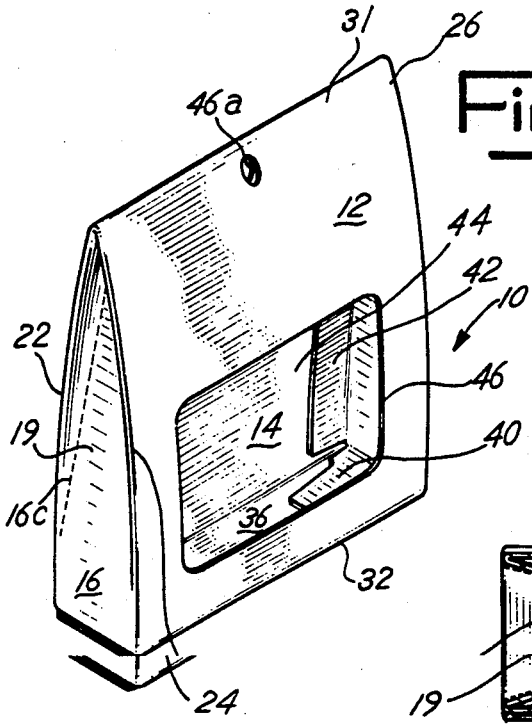
Fig. 1
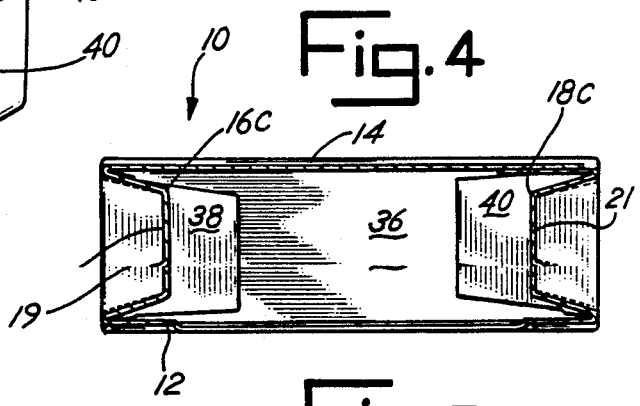
Fig. 4
Fig. 2
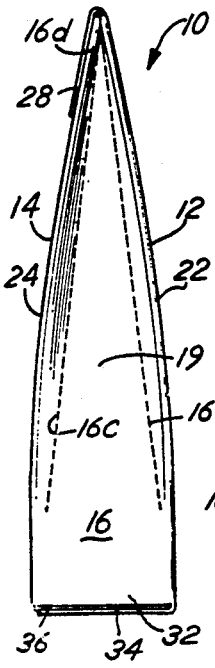
Fig. 5
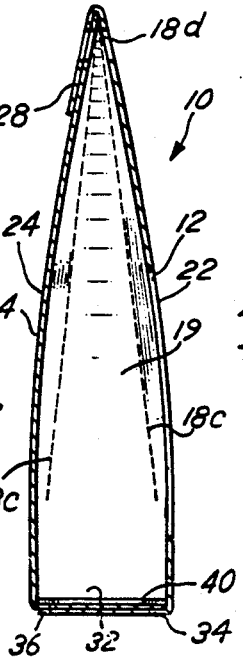
Fig. 3
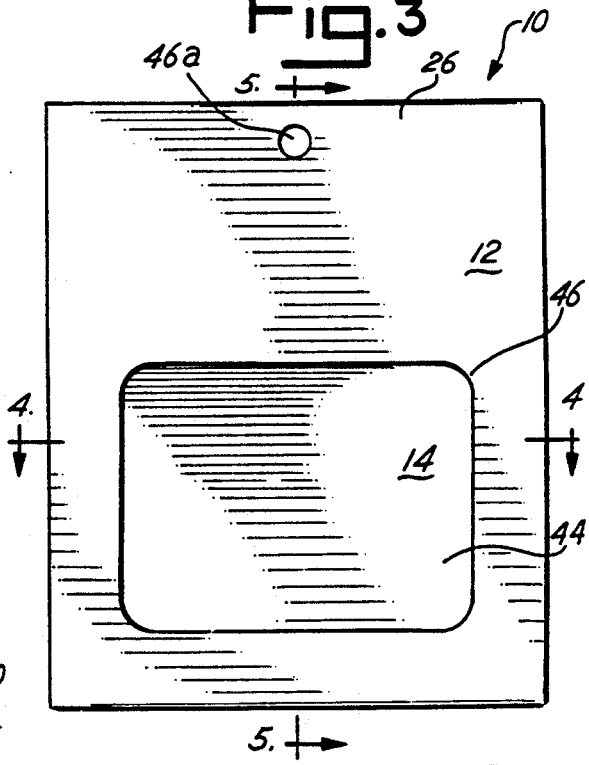

TRIANGULAR CROSS-SECTION PACKAGE

BACKGROUND OF THE INVENTION

The present invention relates to packaging materials, and more particularly to an improved triangular cross-section package, such as may be useful for the packaging of small articles and/or comestibles, more particularly including packets of sliced prepared meat products, inter alia.

In the prior art, new and different means for displaying small articles and comestibles have been desirable. Ideally, such packaging should have a display aperture for viewing the contents. Also, such packaging should be readily stackable, and hangable upon a peg or from other hanging means. Yet further, such packaging should have a minimum of wasted volume, and should be readily susceptible for containing an inner lining of other packaging material, such as a polymeric sheet or other material pouch, which may be sealed or unsealed in various embodiments.

In addition to the above features, packaging for small articles and/or comestibles should be of such a design that it can be readily and not expensively produced on presently existing equipment and with materials which are well known to those of ordinary skill in the packaging arts.

Such packaging also should be readily and not expensively assemblable by available machinery and/or by workers of ordinary skill in the package assembly arts.

Yet additional desirable features of such packaging include the capacity to provide from fibrous or other material a package which provides a certain degree of crush resistance, at least in the lateral dimension, and especially where the contents thereof may be permissibly compressible in the front to back dimension, such as for example in stacking or in hanging.

In view of the above desirable proposed features and/or advantages, and in consideration of the defects, difficulties and deficiencies with certain of the prior art packaging materials presently available for such small articles and/or comestibles, it is a material object of the improved triangular cross-section package of the present invention to alleviate materially those defects, difficulties and deficiencies, and to provide the above and other desirable features and advantages.

SUMMARY OF THE INVENTION

The improved display package of the present invention has a substantially triangular shape in longitudinal cross-section. The package is formed from substantially rectangular front and matching back panels. A pair of side panels are attached to the front and back panels. Each of the side panels is also rectangular in shape in the unfolded state, and has a longitudinal dimension which substantially corresponds to that of the front and back panels.

Each of the rectangular side panels includes fold lines, which may be formed by lines of reduced strength, which fold lines are disposed in a substantially triangular shape on the side panels. The fold lines form a substantially triangular shaped and inwardly disposed end subpanel when in the folded condition. The resulting shape of the package is that of a pouch, but which may be formed from a single sheet of fibrous or other material, such as paper or polymeric sheet material, in some embodiments.

The above features may be more readily understood upon review of the following brief description of the drawing, detailed description of preferred embodiments, appended claims, and accompanying drawings.

BRIEF DESCRIPTION OF THE DRAWING

The improved triangular cross-section package of the present invention is depicted in the following drawings, and in which:

FIG. 1 is a front perspective view of the improved triangular cross-section package of the present invention, and showing the front panel with display aperture and hanging aperture therein, and further showing the side panel in the folded condition and including the substantially triangular and inwardly disposed end subpanel, when in such folded condition;

FIG. 2 is an enlarged left side end-on view, showing the fold lines which form the substantially triangular shape and inwardly disposed end subpanel upon folding, and also showing the folded over top closure panel;

FIG. 3 is an enlarged front view of the improved triangular cross-section packaging of the present invention, showing the substantially rectangular front panel with display aperture and hanging aperture therein;

FIG. 4 is an enlarged transverse cross-sectional view taken along line 4—4 of FIG. 3, and showing the inwardly disposed end triangular shape subpanel on each end of the package, and further showing below such subpanel and extending towards the center of the bottom of the package a pair of side closure panels which are disposed and rest upon a bottom closure panel;

FIG. 5 is an enlarged longitudinal cross-sectional view taken along line 5—5 of FIG. 3, and showing at the bottom thereof the folded over and engaging bottom closure panels, and looking towards the inside surface of the right side of the package showing the right side substantially triangular shaped inwardly disposed end subpanel formed by the fold lines of the right side panel of such package;

DETAILED DESCRIPTION OF PREFERRED EMBODIMENTS

Figure 6:
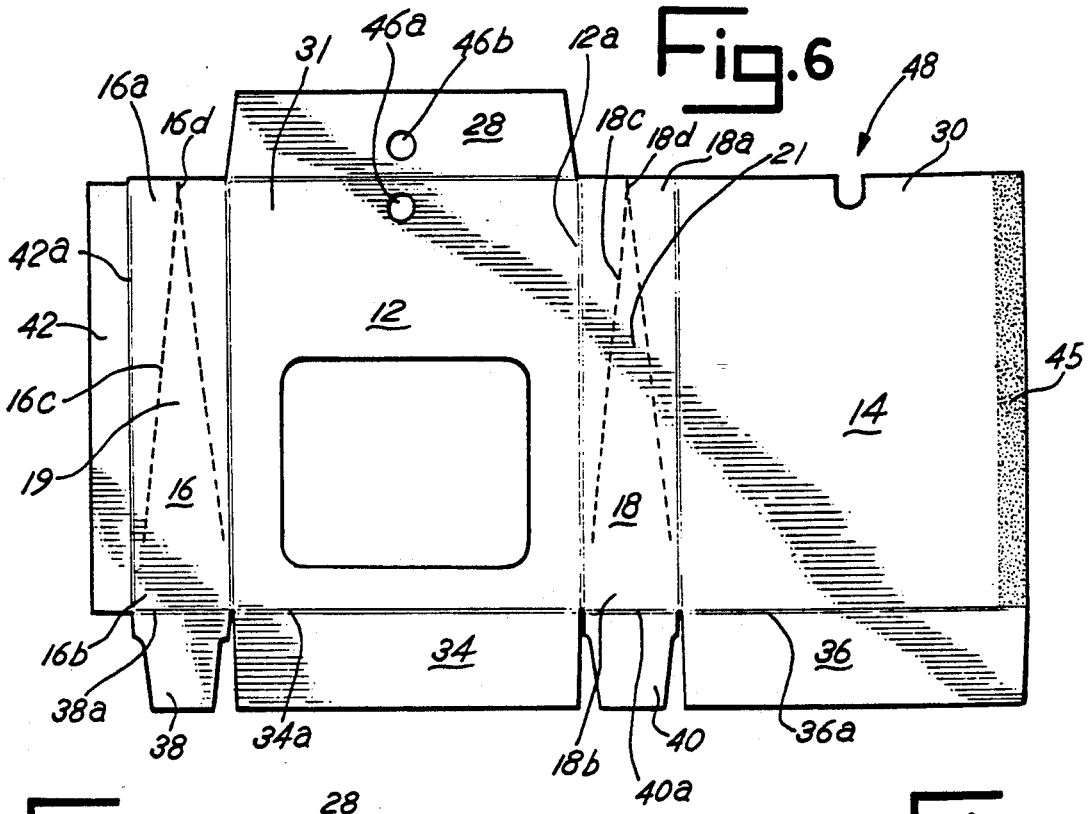
FIG. 6 is a reduced size folded out view of a blank formed from a single sheet of material, and showing the various connected panels, tabs, closure means and fold lines of the improved triangular cross-section package of the present invention in one preferred embodiment.

The improved triangular cross-section package of the present invention comprises a package which has a substantially triangular longitudinal cross-section, and which is substantially triangular when viewed from an end-on perspective thereof. The improved triangular cross-section package of the present invention includes a substantially rectangular front panel and a substantially rectangular back panel which has substantially the same dimensions as those of the rectangular front panel.

A pair of side panels are joined to the front panel and the back panel. The side panels are substantially rectangular in shape in the unfolded condition. Each of the side panels has a top and a bottom. The rectangular longitudinal dimension of the side panels corresponds to the longitudinal dimension of the front panel and the back panel.

The rectangular side panels include fold lines thereon. The fold lines are disposed in a substantially triangular shape to form a substantially triangular shape subpanel, which is inwardly disposed towards the center of the package in the folded condition.

The apex of the fold lines is disposed closely adjacent to the top of the side panels of the package. Such fold lines also in some preferred embodiments terminate a substantial distance above the bottom of the side panels. In these embodiments, the triangular shaped package has lateral sides which cause the triangular shape to become slightly curved, and to cause the front panel and the back panel to bulge slightly outwardly, such as for example to form the pouch-like shape of the package.

In preferred embodiments, a top closure mechanism is disposed on either of the front panel or the back panel near the top for folding over and attachment to the other of the front or back panel. This top closure mechanism may preferably comprise a panel, and which panel may in some preferred embodiments extend substantially across the transverse dimension of the front and/or back panel. These and other top closure means in preferred embodiments upon folding over are connected to a surface, and preferably the exterior surface of the other front and back panels.

In preferred embodiments, the bottom closure mechanism is disposed substantially at the bottom of the package closing the package bottom. In preferred embodiments, the bottom closure mechanism comprises at least one panel which is disposed substantially at the bottom of the package and extends between the front and back panels of the package. Such bottom closure means in preferred embodiments comprises a pair of primary bottom closure panels which are integrally formed with and separated by a fold line from the front and back panels of the package. These and other preferred bottom closure means may further comprise a pair of side closure panels which may also be integrally formed with and separated by a fold line from each of the side panels. In such embodiments the primary bottom closure panels and the side closure panels are folded substantially normal respective to the front and back panels and to the side panels. At least one of the primary bottom closure panels extends substantially the entire distance between the front and back panels in some embodiments.

The improved triangular cross-section package of the present invention may also include a side closure mechanism which is enclosed on a side portion of one of the front and back panels and the side panels, and the adjacent panel for forming a package which is closed on the sides thereof. These and other side closure mechanisms of the present invention may preferably comprise a side closure panel which is connected to one of the front and back panels and to the side of the adjacent panel when the package is in the folded format. The side closure panel may be integrally formed with and separated by a fold line from the panel to which it is attached. The side closure panel is connected to the interior surface of the adjacent panel in preferred embodiments, although it may be connected to the exterior surface of the adjacent panel in other embodiments. Such interior surface in some preferred embodiments may be the interior surface of the front or the back panel in order that the side closure panel does not interfere with the triangularly disposed fold lines on the side panels.

A product display window in the form an aperture may be preferably disposed in one or more panels of the present invention, such as for example the front panel in certain preferred embodiments.

A hanging mechanism is disposed adjacent the top of the package for hanging the package. This mechanism may in preferred embodiments comprise a hanging aperture which may preferably extend through both the front and back panels, such as for use in hanging on a peg board.

The width of the side panels in preferred embodiments is preferably less than the width of the front and back panels, in order to facilitate the pouch-like shape of the improved triangular cross-section package of the present invention.

The fold lines as described hereinabove may comprise lines of reduced dimensional strength, which may be selected with regard to the material from which the side panels have been formed, whether fibrous (such as for example cardboard), corrugated, polymeric sheet material or otherwise. Scorelines may be useful with certain materials, perforations suitable with other materials, etc., each to be selected by those of ordinary skill in the art accordingly to widely known principles.

Of course, the improved triangular cross-section packaging of the present invention may be formed as a blank which has been integrally stamped from a single sheet of material, with all of the panels described hereinabove integrally formed thereon and separated from each other, where appropriate, by a fold and other line. Of course, in other embodiments the improved triangular cross-section package of the present invention may be formed from a plurality of such blanks connected together by techniques known to those of ordinary skill in the art, including supplemental tabs, fitting into slots, adhesives, and other such well known mechanisms.

Referring now to the drawing, FIGS. 1–5 show the improved triangular cross-section package generally 10 of the present invention in its folded format and FIGS. 6–9 show such package 10 at various stages in the folding thereof. Package 10 is substantially triangular when viewed from an end-on perspective thereof, as shown in FIGS. 1, 2 and 5. The improved triangular cross-section package of the present invention includes a substantially rectangular front panel 12 and a substantially rectangular back panel 14 which has substantially the same dimensions as those of rectangular front panel 12.

Figure 7:
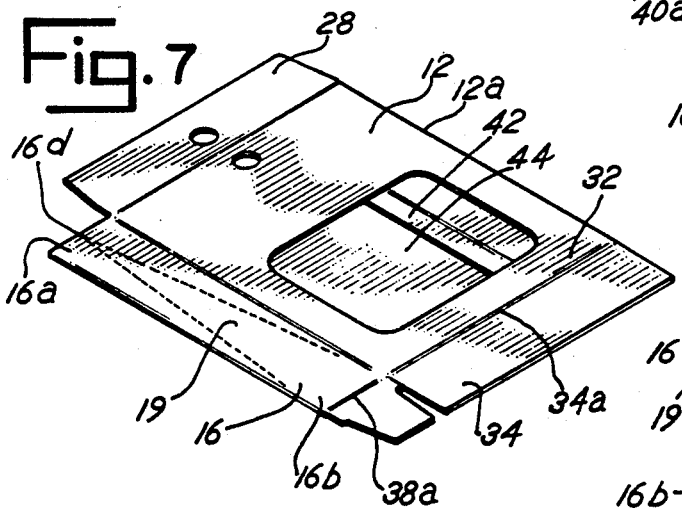
FIG. 7 is a perspective view of an embodiment of the improved triangular cross-section packaging similar to that shown in the blank of FIG. 6 (but, inter alia, with a front aperture window) in a beginning stage of assembly, and in particular showing a blank folded over at the line between the front panel and the right side end panel, with such right side end panel and the attached back panel being folded underneath.
Figure 8:
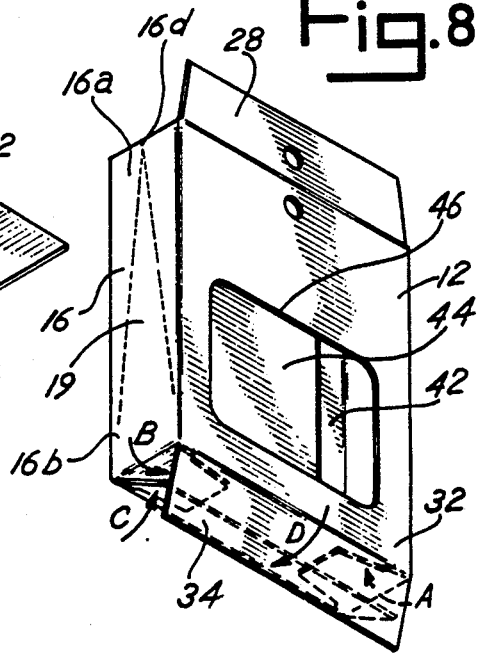
FIG. 8 depicts a subsequent stage in the assembly of the improved triangular cross-section package of the present invention, as shown in FIG. 7, and showing the sides of the packaged formed into a box by means of attachment of the side closure panel to the interior surface of the rear panel, and further showing the bottom closure elements of the box being folded as depicted at arrows A–D.
Figure 9:
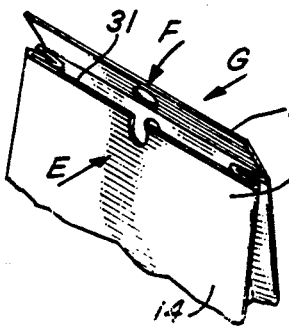
FIG. 9 is a perspective view depicting the back of the improved triangular cross-section package of the present invention, as shown in FIGS. 7 and 8, and showing the back panel being urged into contact with the top portion of the front panel, and further showing the folding over of the top closure panel into contact with the exterior surface of the panel for securement thereto.

A pair of side panels 16,18 comprising left side panel 16 and right side panel 18 are joined to front panel 12 and back panel 14. Side panels 16,18 are substantially rectangular in shape in the unfolded condition, as shown in FIGS. 6, 7 and 8. Each of side panels 16,18 has a top 16*a*, 18*a* and a bottom 16*b*,18*b*. The rectangular longitudinal dimension of the side panels 16,18 corresponds to the longitudinal dimension of front panel 12 and back panel 14, as shown on FIG. 6. Rectangular side panels 16,18 include fold lines 16*c*,18*c* thereon. Fold lines 16*c*,18*c* are disposed in a substantially triangular shape to form respectively substantially triangular shaped subpanels 19,21, each of which is inwardly disposed towards the center of the package in the folded condition, as shown in FIGS. 2 and 5.

Each apex 16*d*,18*d* of fold lines 16,18 is disposed closely adjacent to the respective tops 16*a*,18*a* of side panels 16,18 of package 10. Such fold lines 16*c*,18*c* also in some preferred embodiments terminate a substantial distance above respective bottom 16*b*,18*b* of side panels 16,18. In these embodiments, triangular shaped package 10 has lateral sides 22,24 which cause the triangular shape to become slightly curved, and to cause front panel 12 and back panel 14 to bulge slightly outwardly as shown in FIGS. 1, 2 and 5, such as for example to form the pouch-like shape of package 10.

In preferred embodiments, a top closure mechanism is disposed on either of front panel 12 or back panel 14 near top 26 of package 10 for folding over and attachment to the other of front 12 or back panel 14. Such closure mechanism may preferably comprise a top closure panel 28, and which may in some preferred embodiments extend substantially across the transverse dimension of front panel 12 and/or back panel 14, as shown. These and other top closure means in preferred embodiments upon folding over are connected to a surface, and preferably the exterior surface 30 of back panel 14.

In preferred embodiments, the bottom closure mechanism as depicted in FIGS. 4, 6, 7 and 8 is disposed substantially at the bottom 32 of package 10. In preferred embodiments, the bottom closure mechanism comprises a pair of primary bottom closure panels 34,36 which are disposed substantially at bottom 32 of package 10 and extend between front and back panels 12,14 of package 10. Primary bottom closure panels 34,36 are integrally formed with and separated by respective fold lines 34*a*,36*a* from front and back panels 34,36 of package 10, as shown in FIG. 6. These and other preferred bottom closure means may further comprise a pair of side closure panels 38,40 which may also be integrally formed with and separated by respective fold lines 38*a*,40*a* from each of side panels 16,18. In such embodiments, primary bottom closure panels 34,36 and side closure panels 38,40 are folded substantially normal respective to front and back panels 12,14 and to side panels 16,18. As shown, primary bottom closure panels 34,36 extend the entire distance between front and back panels 12,14.

Improved triangular cross-section package 10 of the present invention may also include a side closure mechanism as shown in FIGS. 1, 6, 7 and 8. Such side closure mechanism is attached at a side portion of one of front and back panels 12,14 and side panels 16,18, and the adjacent panel for forming a package which is closed on the sides thereof. As shown, the side closure mechanism of the present invention may preferably comprise side closure panel 42 which as integrally formed with and separated by a fold line 42*a* from side panel 16. FIGS. 6 and 7–9 show embodiments with different positionings of side closure panel 42. The side closure panel 42 is shown as connected to interior surface 44 of rear panel 14 in preferred embodiments, although it may be connected to an exterior surface glue line 45 in other embodiments.

A product display window or aperture 46 is disposed in front panel 12.

A hanging mechanism is disposed at the top 26 of package 10 for hanging the package, and hanging apertures 46*a*,46*b* which may preferably extend through front and back panels 12,14, such as for use in hanging on a peg board, are provided therein.

The width of side panels 16,18 is shown as being less than the width of front and back panels 12,14, in order to facilitate the pouch-like shape of the improved triangular cross-section package 10 of the present invention.

Improved triangular cross-section package 10 of the present invention may be formed from a blank generally 48, as shown in FIG. 6. Such blank 48 has been integrally stamped from a single sheet of material, with all of the various panels described hereinabove integrally formed thereon and separated from each other, where appropriate, by a fold or other line, as depicted. Of course, in other embodiments the improved triangular cross-section package 10 of the present invention may be formed from a plurality of such blanks connected together by techniques known to those of ordinary skill in the art, including supplemental tabs, fitting into slots, adhesives, and other such well known mechanisms.

FIGS. 6, 7, 8, and 9 depict the various stages of assembly of embodiments of package 10. Beginning with a flat blank, such as blank 48 as shown in FIG. 6, the blank 48 is folded generally in half longitudinally, such as a along fold line 12*a* as shown in FIG. 7, and side closure panel 42 is attached to glue line 45, or other glue line depending on the positioning of closure panel 42, to form the lateral sides of the package 10. Next, the bottom of the package is formed by folding up respectively bottom panels 40, 38, 36 and 34 as shown respectively by Arrows A–D in FIG. 8. Finally, triangular shaped fold lines 16*c*, and 16*d* are folded to dispose triangular subpanels 19,21 inwardly, as shown at FIGS. 1, 2, 4 and 5, by urging the top 30 of rear panel 14 toward the top 31 of front panel 12 (Arrow E). Top closure panel 28 is then folded over top 30 of rear panel 14 (Arrows F and G) to complete the assembly of package 10.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. An improved display package having a substantially triangular end-on shape, said display package comprising:

a substantially rectangular front panel and a matching substantially rectangular back panel having substantially the same dimensions as those of said rectangular front panel;

a pair of side panels which are substantially rectangular in shape in the unfolded condition, each of said side panels joined at borders to said front panel and said back panel, each said rectangular side panel having a top and a bottom, each said rectangular side panel having a longitudinal dimension substantially equal to the longitudinal dimension of said front panel and said back panel, each of said rectangular side panels having fold lines thereon, said fold lines disposed in a substantially triangular shape within and spaced from the borders of said side panels to form a substantially triangular shape inwardly disposed end subpanel in the folded condition, said front panel and said rear panel having respective bottom edges disposed at the base of package and respective top edges disposed at the top of the package, said front panel and said rear panel sloping substantially smoothly from the respective bottom edges thereof upwardly into intersectingly converging relationship at the respective top edges thereof.

2. The improved display package of claim 1 wherein the apex of said fold lines disposed in a triangular shape is disposed closely adjacent to the top of said side panel of the package.

3. The improved display package of claim 1 wherein said fold lines disposed in a triangular shape terminate a substantial distance above the bottom of said side panel, thereby to form a substantially triangular shaped package, the lateral sides of which triangular shape are curved to cause said front panel and said back panel to bulge outwardly.

4. The improved display package of claim 1 further comprising a top closure means disposed upon one of said front panel and said back panel near the top thereof for folding over the other of said front and back panel for attachment thereto.

5. The improved display package of claim 4 wherein said top closure means comprises a panel which extends substantially across the transverse dimension of one of said front and back panels.

6. The improved display package of claim 4 wherein said top closure means upon folding over is connected to the exterior surface of the other of said front and back panels.

7. The improved display package of claim 1 further comprising bottom closure means disposed substantially at the bottom of the package for closing the package bottom.

8. The improved display package of claim 7 wherein said bottom closure means comprises at least one panel disposed substantially at the bottom of and extending between said front and back panels.

9. The improved display package of claim 8 wherein said bottom closure means comprises a pair of primary bottom closure panels integrally formed with and separated by a fold line from said front and back panels.

10. The improved display package of claim 9 wherein said bottom closure means further comprises a pair of side closure panels integrally formed with and separated by a fold line from each of said side panels.

11. The improved display package of claim 10 wherein each of said primary bottom closure panels and said side closure panels is folded substantially normal respectively to said front and back panels and said side panels.

12. The improved display package of claim 9 wherein at least one of said primary bottom closure panels extends substantially the entire distance said front and back panels.

13. The improved display package of claim 1 further comprising side closure means disposed on a side portion of one of said front and back panels and said side panels and the adjacent panel for forming a package closed on the sides thereof.

14. The improved display package of claim 13 wherein said side closure means comprises a side closure panel connected to one of said front and back panels and said side panel and respectively the adjacent panel when the package is in folded format.

15. The improved display package of claim 14 wherein said side closure panel is integrally formed with and separated by a fold line from the panel to which it is attached.

16. The improved display package of claim 14 wherein said side closure panel is connected to the interior surface of the adjacent panel.

17. The improved display package of claim 16 wherein said interior surface is the interior surface of one of said front and back panels, whereby said side closure panel does not interfere with said triangular disposed fold lines on said side panels.

18. The improved display package of claim 1 further comprising a product display window disposed in said front panel.

19. The improved display package of claim 1 further comprising hanging means disposed adjacent said top of the package for hanging thereof.

20. The improved display package of claim 19 wherein said hanging means comprises an aperture which extends through said front and back panels.

21. The improved display package of claim 1 wherein the width of said side panel is less then the width of said front and back panels.

22. The improved display package of claim 1 wherein said fold lines comprise lines of reduced strength.

23. The improved display package of claim 22 wherein said lines of reduced strength comprise score lines.

24. The improved display package of claim 22 wherein said lines of reduced strength comprise perforated lines.

* * * * *